US008180258B2

(12) United States Patent
Takashima

(10) Patent No.: US 8,180,258 B2
(45) Date of Patent: May 15, 2012

(54) IMAGE FORMING APPARATUS WITH REDUCTION OF OPERATION NOISE

(75) Inventor: Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 396 days.

(21) Appl. No.: 12/546,980

(22) Filed: Aug. 25, 2009

(65) Prior Publication Data

US 2010/0226663 A1 Sep. 9, 2010

(30) Foreign Application Priority Data

Mar. 5, 2009 (JP) ..... P2009-052417

(51) Int. Cl.
*G03G 15/01* (2006.01)

(52) U.S. Cl. ..... 399/227; 399/12

(58) Field of Classification Search ..... 399/226–227, 399/12

See application file for complete search history.

(56) References Cited

U.S. PATENT DOCUMENTS

| | | | | |
|---|---|---|---|---|
| 7,024,138 | B2 * | 4/2006 | Ikeda et al. | 399/227 |
| 7,076,179 | B2 * | 7/2006 | Nakazato | 399/13 |
| 7,155,147 | B2 * | 12/2006 | Wakahara | 399/227 |
| 7,536,116 | B2 * | 5/2009 | Yamasaki et al. | 399/12 |
| 2004/0184838 | A1 * | 9/2004 | Ikeda et al. | 399/227 |
| 2005/0158080 | A1 * | 7/2005 | Wakahara | 399/227 |
| 2006/0051128 | A1 * | 3/2006 | Takahata et al. | 399/116 |
| 2006/0263107 | A1 * | 11/2006 | Inukai et al. | 399/27 |
| 2006/0291873 | A1 * | 12/2006 | Shishikura et al. | 399/13 |
| 2007/0183812 | A1 * | 8/2007 | Takashima et al. | 399/227 |
| 2009/0028608 | A1 * | 1/2009 | Takashima | 399/227 |

FOREIGN PATENT DOCUMENTS

| | | |
|---|---|---|
| JP | 2003-098789 A | 4/2003 |
| JP | 2007-212791 A | 8/2007 |

* cited by examiner

*Primary Examiner* — David Gray
*Assistant Examiner* — G. M. Hyder
(74) *Attorney, Agent, or Firm* — Morgan, Lewis & Bockius LLP

(57) ABSTRACT

A replacing mouth 5 for replacing each of toner cartridges 40 is provided at such a position that when any of developer units 32 stops at a developing position 38, the toner cartridge 40 adjacent to the pertinent developer unit 32 and supplementing the toner to another developer unit 32 different from the pertinent developer unit 32 can be replaced. Further, an information reading device 46 for reading the information from the storage medium 42 included in each of the toner cartridges 40 reads the information from the storage medium when any of the developer units 32 is located at the developing position 38.

4 Claims, 11 Drawing Sheets

IMAGE FORMING APPARATUS WITH REDUCTION OF OPERATION NOISE

CROSS-REFERENCE TO RELATED APPLICATION

This application is based on and claims priority under 35 USC 119 from Japanese Patent Application No. 2009-052417 filed on Mar. 5, 2009.

BACKGROUND

1. Technical Field

This invention relates to an image forming apparatus.

2. Related Art

In some image forming apparatus of transferring toner to an electrostatic latent image on an image holder to form a visual image, developer units accommodating toners with plural different colors are successively moved to a position opposite to the image holder so that the toner images with the respective colors are formed on the single image holder. As widely known, the developer units are supported by a rotary body rotatable around an axial line and are caused to be opposite to the image holder by rotation of the rotary body, respectively.

Some toner cartridges contain a storage medium storing information on the toner cartridge, e.g. the color of the toner, kind of the toner, using history of the toner cartridge and a manufacturer. As regards this storage medium, in the state where it is mounted in the image forming apparatus, information stored in the storage medium is read and new information is written therein.

SUMMARY

According to an aspect of the invention, an image forming apparatus includes: an image holder on which an electrostatic latent image due to a difference in a charging potential is formed; a developing unit that transfers toners to the electrostatic latent image formed on the image holder to form a visual image; a transfer device that transfers the visual image onto a recording sheet; and a supporting structure that supports the image holder and the developing unit. The developing unit includes: a rotary body of which supporting shaft is supported at both ends by the supporting structure and which is rotatable around an axial line of the supporting shaft; plural developer units that are arranged in a circumferential direction and supported by the rotary body and respectively have developer holders for holding developers to develop the electrostatic latent image of the image holder; and toner cartridges provided to supplement toners to the developer units, respectively so as to be attached to or detached from the rotary body. The plural developer units and the toner cartridges are alternately arranged in the circumferential direction of the rotary body, at least one of the plural toner cartridges is larger than the other toner cartridges in the circumferential direction of the rotary body. The supporting structure is provided with a replacing mouth that permits each of the toner cartridges to be inserted in or pulled out from the rotary body in an axial direction thereof. The replacing mouth is located at a position that when one of the developer holders stops at a position for executing development in opposition to the image holder, the toner cartridge arranged adjacently to the developer unit having the developer holder and supplementing the toner to the other developer unit different from the developer unit is capable to be replaced.

BRIEF DESCRIPTION OF THE DRAWINGS

Exemplary embodiments of the present invention will be described in detail based on the following figures, wherein.

DETAILED DESCRIPTION

Hereinafter, an explanation will be given of exemplary embodiments of this invention.

Figure 1:
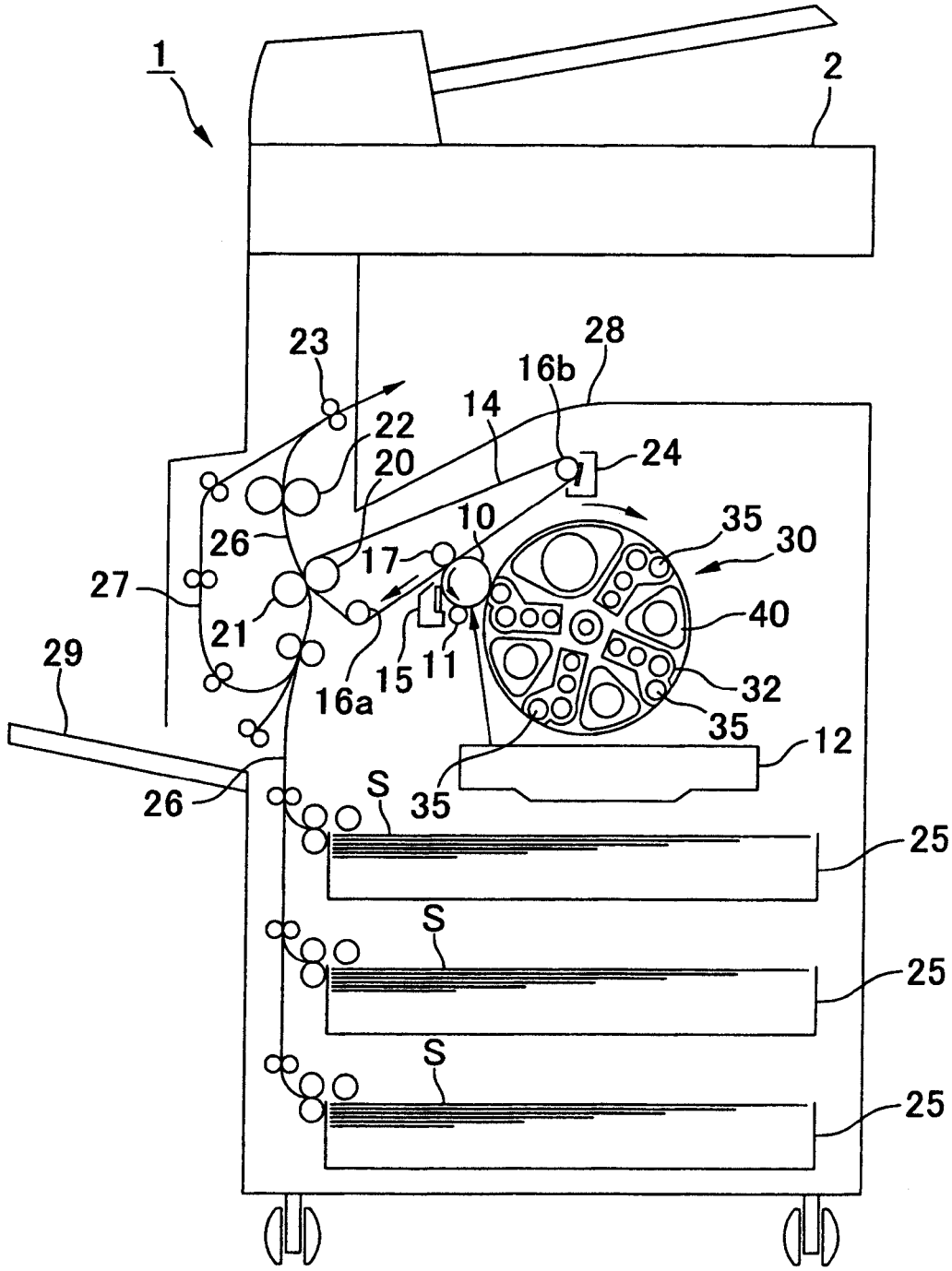
FIG. 1 is a schematic construction view showing an image forming apparatus according to an exemplary embodiment of this invention.

FIG. 1 is a schematic construction view showing an image forming apparatus according to an exemplary embodiment of this invention. This image forming apparatus 1 includes a photosensitive drum 10 having a photoconductive layer formed on the outer surface of a cylindrical member made of a conductive material, which is a typical image holder on which an electrostatic latent image due to a difference in a charging potential is formed. Around the photosensitive drum 10, the image forming apparatus 1 includes a charging device 11 which uniformly charges the surface of the photosensitive drum 10; an exposure device 12 which applies image light to the charged photosensitive drum 10 to form the latent image on the surface thereof; a rotary-type of developing unit 30 which transfers toner to the latent image on the photosensitive drum 10 to form a toner image; an intermediate transfer body 14 in an endless belt shape which is opposite to the photosensitive drum 10 and whose periphery is circulatably supported; a transfer roll 21 which transfers the toner image transferred onto the intermediate transfer body 14 to a recording sheet, which is an exemplary transfer device; and a cleaning device 15 which eliminates the toner remaining on the photosensitive drum 10 after the toner image has been transferred.

As an example of the transfer device, this exemplary embodiment adopts the manner of transfer onto the recording sheet through the intermediate transfer body 14, but may adopt the manner of direct transfer from the photosensitive drum 10 onto the recording sheet.

The intermediate transfer body 14 is circulatably stretched by two supporting rolls 16*a*, 16*b* and a transfer opposite roll 20 for secondary transfer. At an inside position of the intermediate transfer body 14 opposite to the photosensitive drum 10, a transfer charger 17 is provided which primarily transfers the toner image on the photosensitive drum 10 onto the intermediate transfer body 14. At a position opposite to the transfer opposite roll 20 through the intermediate transfer body 14, the transfer roll 21 is provided which secondarily transfers the toner image on the intermediate transfer body 14 to the recording sheet. The recording sheet will be fed into a pressure-contact portion between the transfer opposite roll 20 and the transfer roll 21 via a transporting path 26 from sheet trays 25.

Downstream of the secondary transfer position in the circulating direction of the transfer body 14, a cleaning device 24 is provided which eliminates the toner remaining on the photosensitive drum 10.

Downstream of the secondary transfer position in the direction of transporting the recording sheet, provided are a fixing device 22 which heats the non-fixed toner image on the recording sheet so as to be pressure-put thereon and an ejecting roll 23 which ejects the recording sheet onto a sheet ejecting tray 28. On a transporting path from the fixing device 22 to the sheet ejecting tray 28, a branch is formed to provide a both-sided transporting path 27 which turns the recording sheet inside out and transports it upstream of the position where the transfer roll 21 is provided.

On the image forming apparatus 1, an image informing reading device 2 is provided which reads an manuscript image, and on the side thereof, a manual feeding tray 29 is provided.

Figure 2:
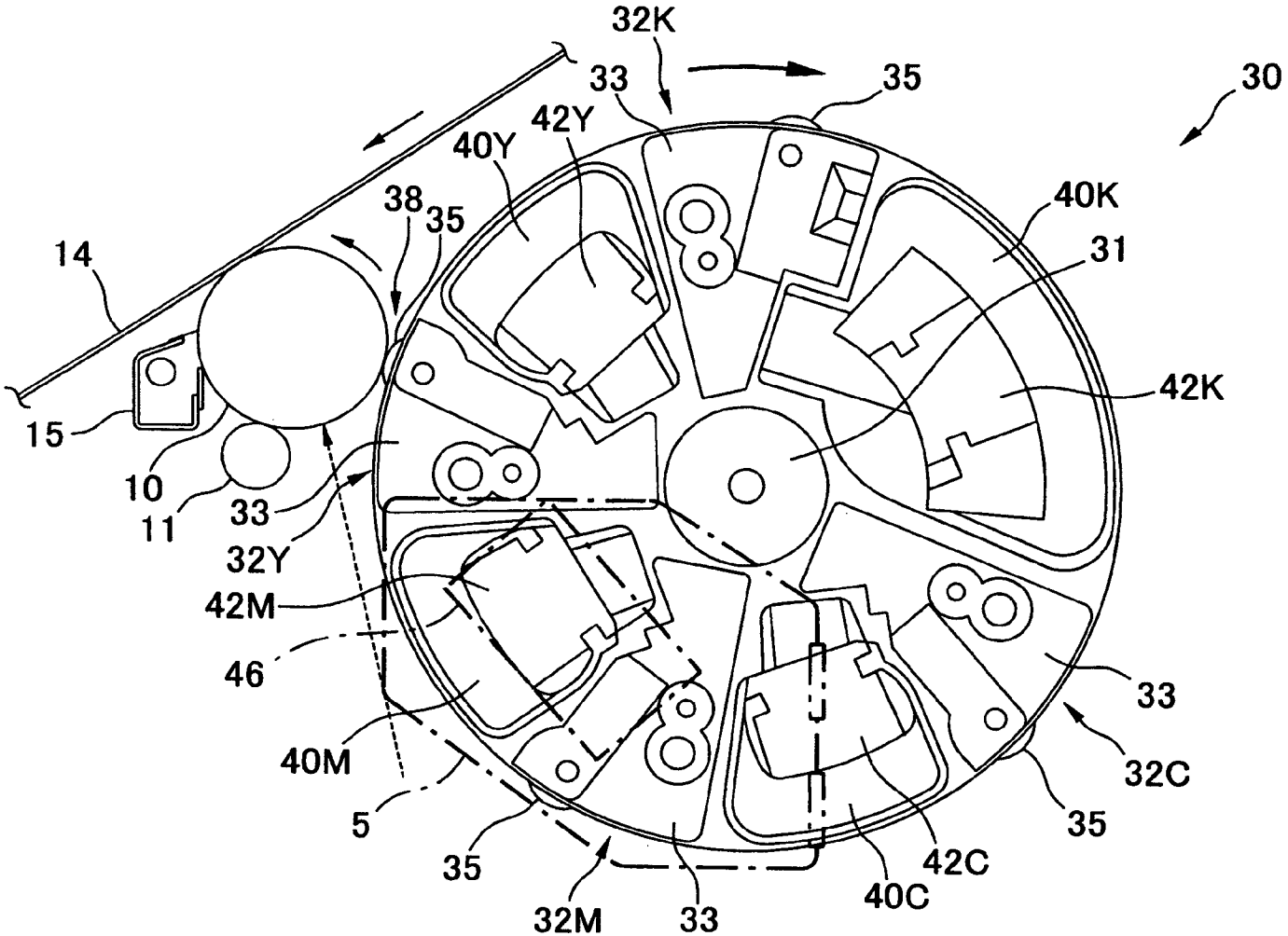
FIG. 2 is a schematic construction view showing a developing unit included in the image forming apparatus shown in FIG. 1 and the position of a replacing mouth of a toner cartridge included in the developing unit.

The developing unit 30, as shown in FIG. 2, includes a rotary holder 31 which is rotatably driven; four developer units 32C, 32M, 32Y, 32K which accommodate toners of cyan, magenta, yellow, black, respectively; and four toner cartridges 40C, 40M, 40Y, 40K which accommodate the toners for supplementing the toners consumed by these toner developer units 32. When the rotary holder 31 is rotation-driven, the respective developer units 32C, 32M, 32Y, 32K are selectively located at an area opposite to the photosensitive drum 10, i.e. a developing position 38.

In this exemplary embodiment, the rotary holder 31 and photosensitive drum 10 are rotated in the direction of arrows in FIG. 2, respectively. In the rotating direction of the photosensitive drum 10, the developer units 32C, 32M, 32Y, 32K accommodating the tones of cyan, magenta, yellow, black, respectively, are successively arranged.

Each developer units 32C, 32M, 32Y, 32K includes a housing 33 accommodating a two-component developer including a toner and a magnetic carrier; a developing roll 35 arranged proximately oppositely to the photosensitive drum 10, which is an exemplary developer holder; and a transporting member (not shown) which stirs the two-component developer and also transports it in an axial direction.

The housing 33 is opened at its position opposite to the photosensitive drum 10; at this area, the developing roll 35 is arranged proximately oppositely to the photosensitive drum 10. The two-component developer is transported by the transporting member within the housing 33 and supplied onto the periphery of the developing roll 35.

Figure 3:
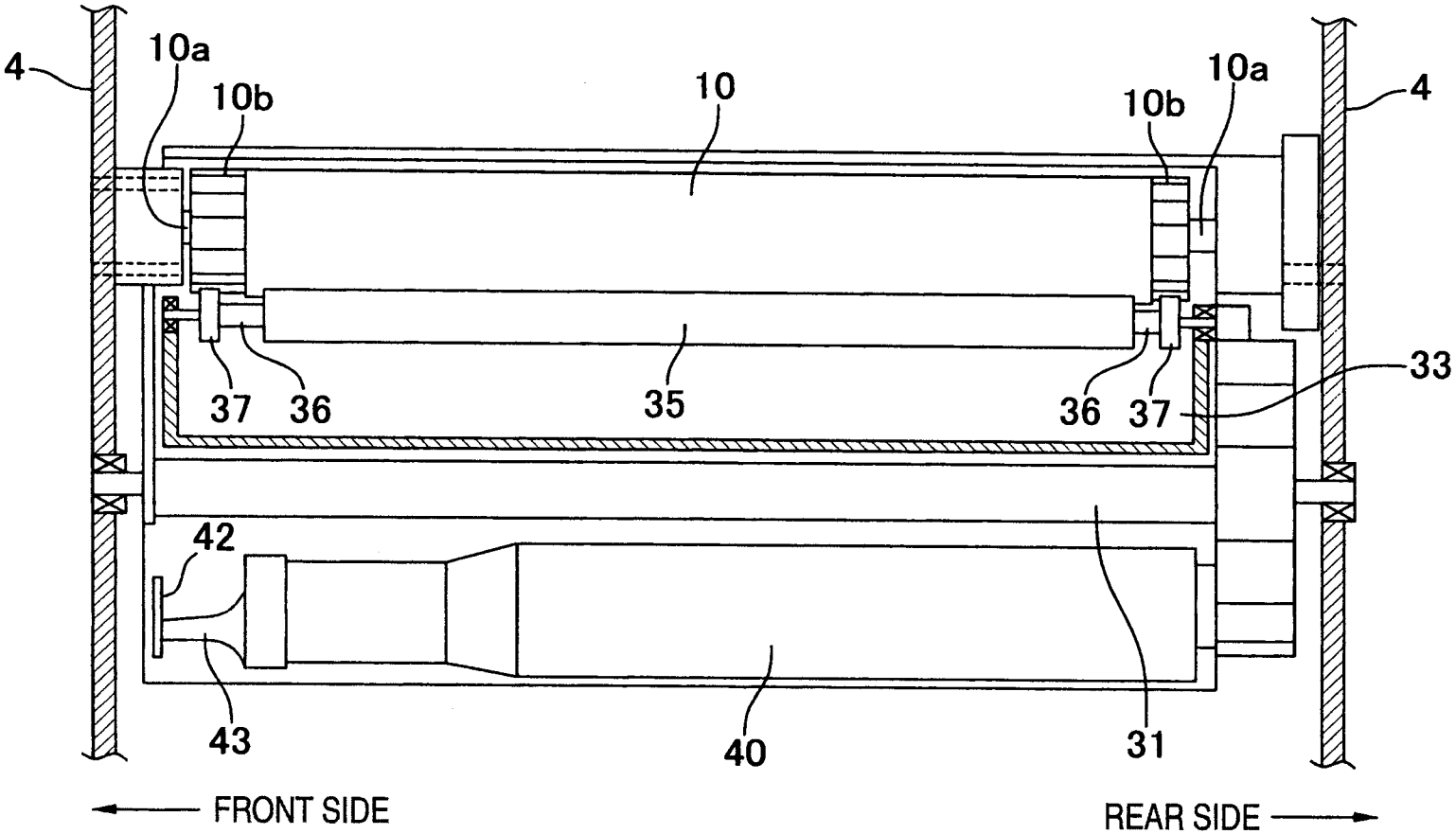
FIG. 3 is a schematic plan sectional view of a developing unit and a photosensitive drum included in the image forming apparatus shown in FIG. 1.

At both ends of the supporting shaft 36 of the developing roll 35, as shown in FIG. 3, tracking rolls 37 are supported. On the other hand, at the position opposite to the tracking roll 37, an opposite member 10*b* formed in a roll-shape having the same diameter as that of the photosensitive drum 10 is supported by a supporting shaft 10*a* of the photosensitive drum 10. The opposite member 10*b* is circulated with rotation of the photosensitive drum 10.

The tracking roll 37 has an outer diameter larger than that of the developing roll 35; when the developing roll 35 is supported at the position opposite to the photosensitive drum 10, i.e. a developing position 38, the tracking roll 37 comes in contact with the opposite member 10*b* so that the tracking roll 37 rotates to follow the rotation of the opposite member 10*b*. Thus, the developing roll 35 located at the developing position 38 will become opposite to the photosensitive drum 10 while keeping a certain gap from the photosensitive drum 10. This gap is preset so that the toner is stably transferred to the electrostatic latent image on the photosensitive drum 10 to permit satisfactory development. On the basis of this preset value, the diameter of the tracking roll 37 is determined.

In the circumferential direction of the rotary holder 31, the toner cartridges 40C, 40M, 40Y, 40K are arranged alternately to the developer units 32C, 32M, 32Y, 32K, and supplement the toners to the corresponding developer units 32C, 32M, 32Y, 32K with toner consumption due to the development. Thus, the toner density of the two-component developer is controlled to be nearly constant. Further, when the nearly entire quantity of the toner accommodated in the toner cartridge 40 is supplemented to the developer unit 32, the toner cartridge 40 is pulled out from the rotary holder 31 in the axial direction of the rotary holder 31 and replaced by a new toner cartridge.

The toner cartridge 40K which accommodates a black toner is formed in a size larger than those of the other toner cartridges 40C, 40M, 40Y in the circumferential direction. The three toner cartridges 40C, 40M, 40Y which accommodate the toners other than the black toner are formed in nearly the same size.

In this exemplary embodiment, in the rotating direction of the developing unit 30, the developer unit 32K for black, toner cartridge 40K for black, developer unit 32C for cyan, toner cartridge 40C, developer unit 32M for magenta, toner cartridge 40M for magenta, developer unit 32Y for yellow and toner cartridge 40Y for yellow are arranged in this order.

Since the size of the toner cartridge 40K for black is different from those of the other toner cartridges 40C, 40M, 40Y, the developer units 32 and toner cartridges 40 are arranged non-symmetrically with respect to the rotary center of the rotary holder 31.

Figure 4:
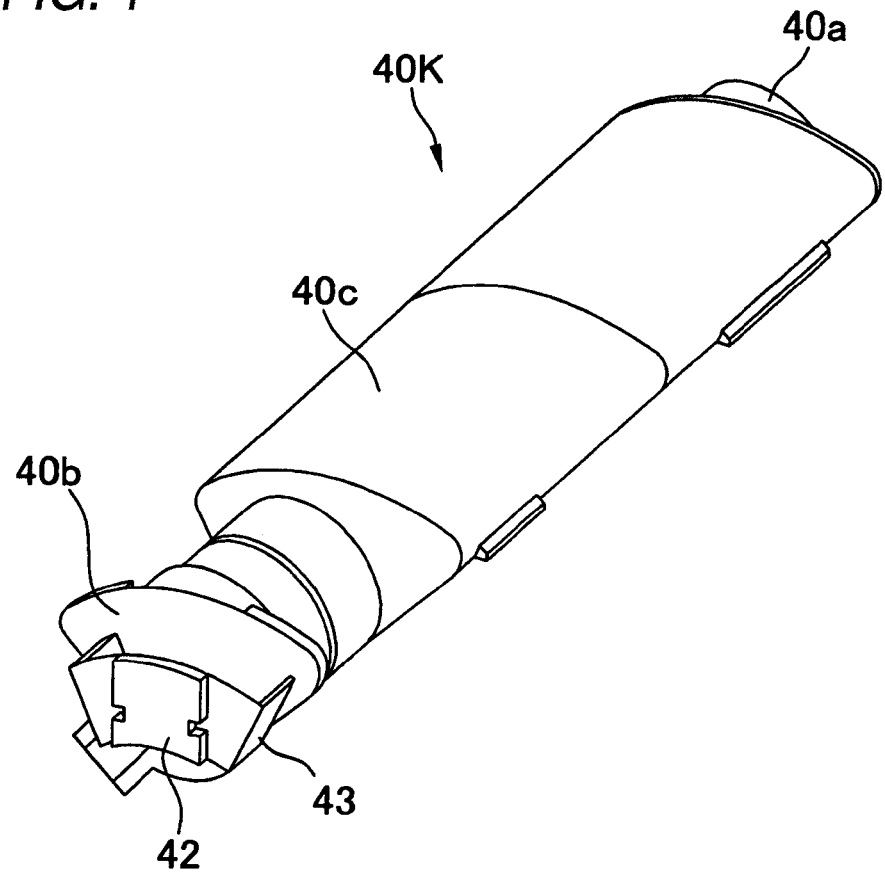
FIG. 4 is a schematic perspective view of a toner cartridge mounted in the developing unit shown in FIG. 2.
Figure 5:
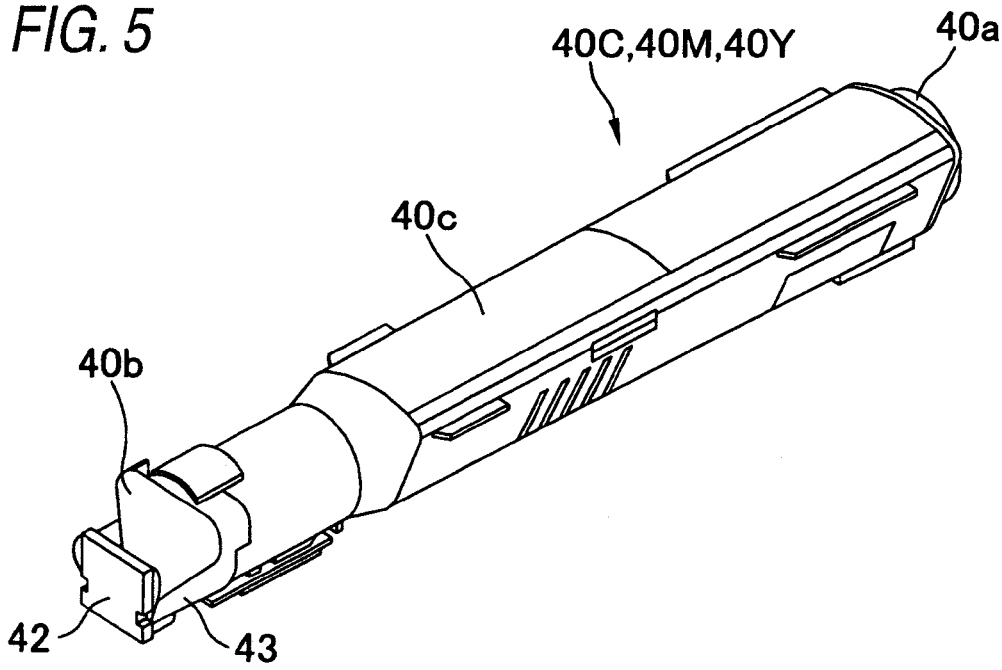
FIG. 5 is a schematic perspective view of a toner cartridge mounted in the developing unit shown in FIG. 2.

In each toner cartridge 40, as shown in FIGS. 4 and 5, the segment 40*c* along the outer periphery of the rotary holder 31 is curved to form a nearly fan-shape in section; within the toner cartridge 40, a stirring wing (not shown) for stirring the toner is provided.

The front end 40*a* of the toner cartridge 40 in the direction of mounting it into the rotary holder 31 serves as a drive transmitting portion to follow the stirring wing, which is connected to a driving portion provided in the rotary holder 31 to transmit rotary driving force. Therefore, with the toner cartridge 40 being mounted in the rotary holder 31, the stirring wing is rotation-driven.

At the rear end of each toner cartridge 40C, 40M, 40Y, 40K in the mounting direction, an IC chip holder 42 is supported by a supporting piece 43 protruding rearward and this IC chip holder 42 incorporates an IC chip (not shown) which is a storage medium. The IC chip stores information peculiar to the pertinent toner cartridge such as the color of the toner, kind of the toner, using history of the toner cartridge, consumed quantity of the toner and a manufacturer. These items of information are communicatable to an information reading device arranged in non-contact with the IC chip.

The zone between the IC chip holder 42 and the rear end 40*b* of the toner cartridge 40 constitutes a space so that an operator can put his hand into this space to grasp the IC chip holder 42 and pull out the toner cartridge 40. Namely, the IC chip holder 42 also serves as a knob in taking out the toner cartridge 40.

Figure 6:
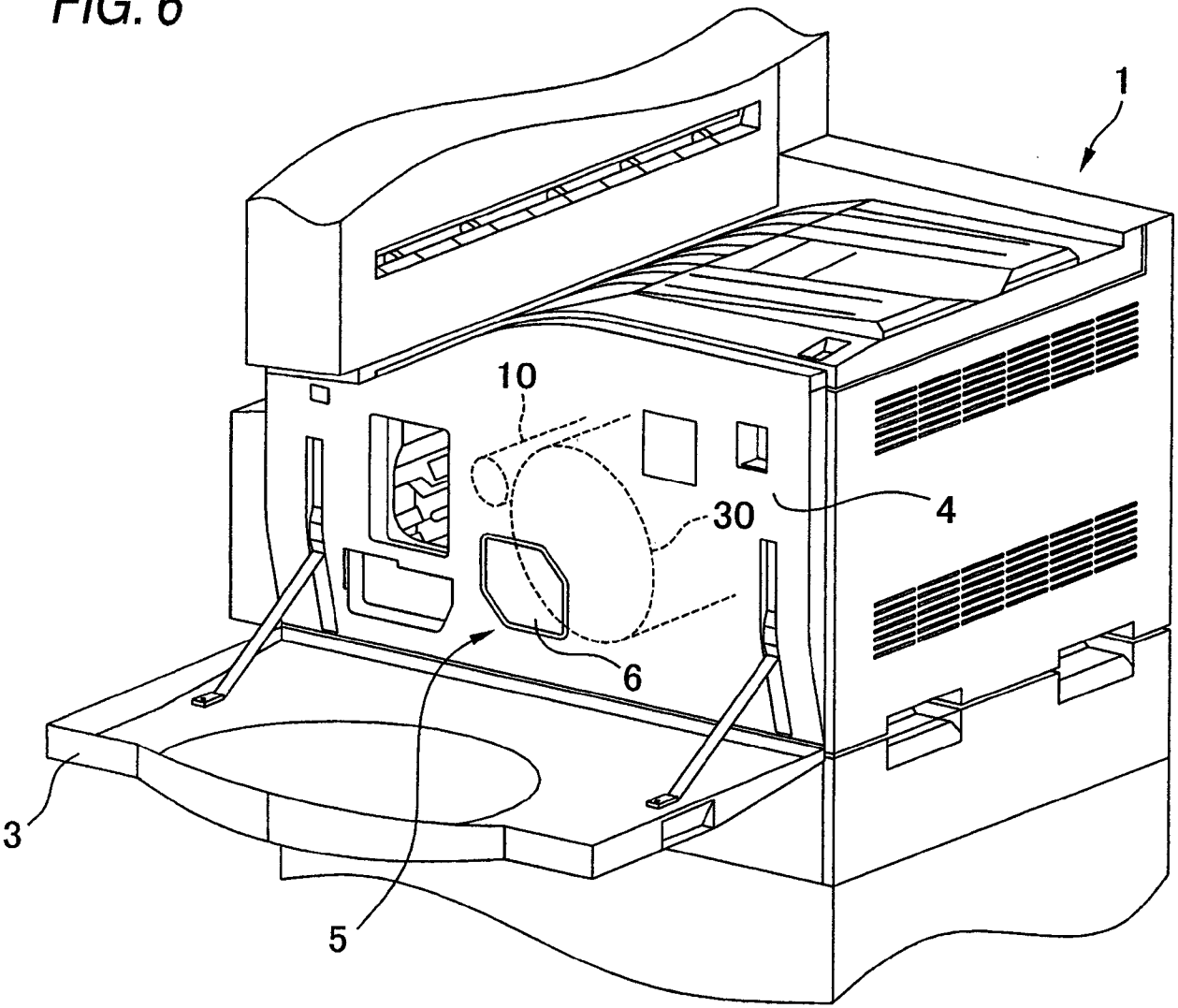
FIG. 6 is a schematic view showing the state where a front panel of the image forming apparatus shown in FIG. 1.
Figure 7:
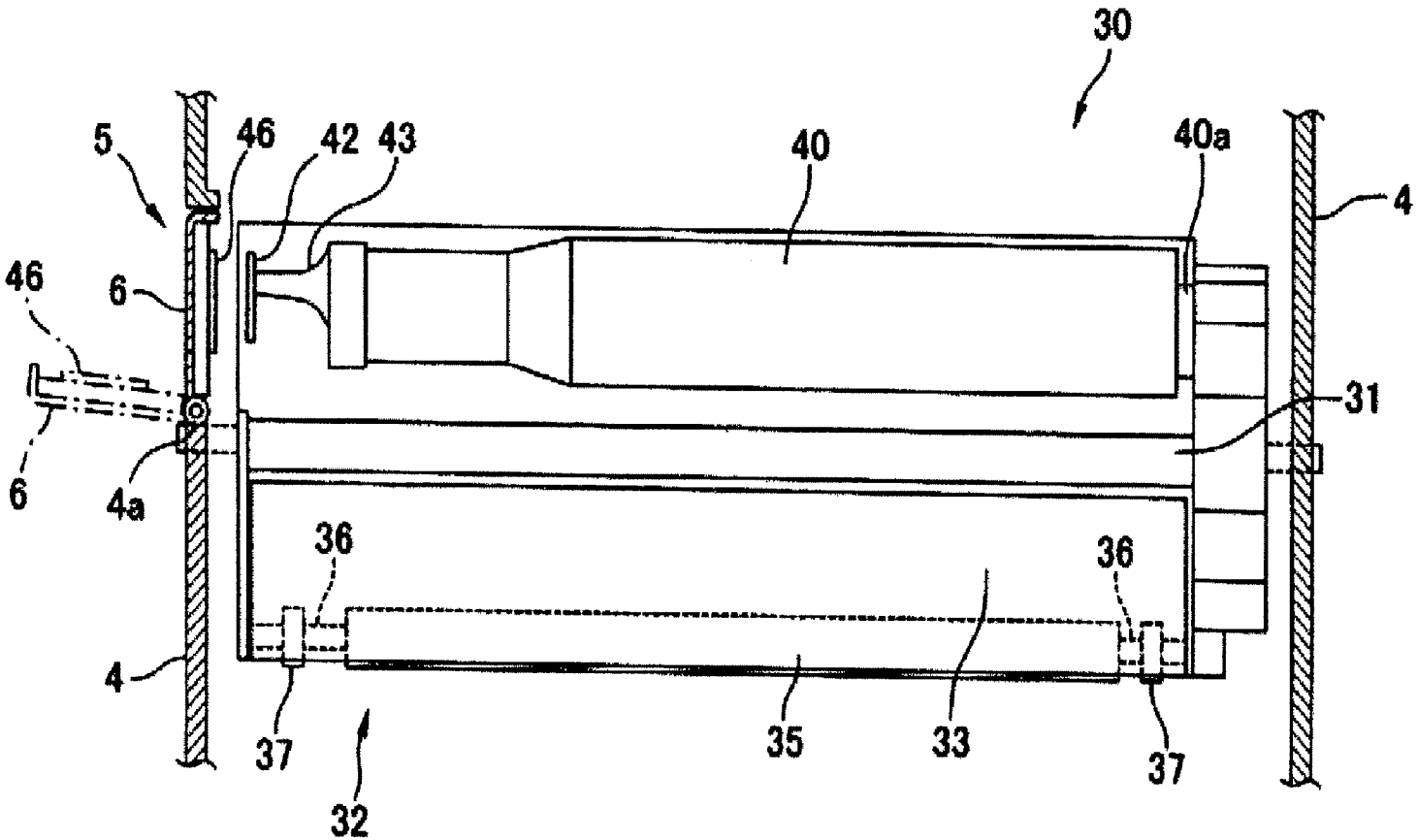
FIG. 7 is a schematic plan sectional view showing a toner cartridge and a replacing mouth thereof.

The above developing unit 30 and photosensitive drum 10, as shown in FIG. 3, are supported by a supporting structure 4. On the front side of the toner cartridge 40, i.e., the side where the operator operates, as shown in FIGS. 6 and 7, a replacing mouth 5 of the toner cartridge 40 is provided. An open/close door 6 is attached to the replacing mouth 5 so that when the operator opens the open/close door 6, he can access one of the toner cartridges 40 and so attaché/detach this toner cartridge 40 through this replacing mouth 5.

It should be noted that on the outside of the supporting structure 4, as shown in FIG. 6, a front panel 3 is provided so as to cover the supporting structure 4 and replacing mouth 5 so that it can be opened/closed.

The replacing mouth 5 is provided at such a position that when the one developer unit 32 is located at the position opposite to the photosensitive drum 10, i.e. the developing position 38, the toner cartridge 40 arranged adjacently to the pertinent developer unit 32 and supplementing the toner to the other developer unit can be replaced.

For example, as shown in FIG. 2, when the developer unit 32Y accommodating the yellow toner is located at the developing position 38, the yellow toner cartridge 40Y and magenta toner cartridge 40M are adjacent to the pertinent developer unit 32Y; the replacing mouth 5 is provided at such a position that the magenta toner cartridge 40M which supplements the toner to the other developer unit, i.e. developer unit 32M for magenta can be attached or detached. If the toner cartridge which supplements the developer unit at the developing position 38, i.e., yellow toner cartridge 40Y in the state shown in FIG. 2 is replaced, disconnection and connection of the toner supplementing path are done so that the developer unit 32Y for yellow suffers from vibration and displacement. Owing to such vibration and displacement, the developer unit 32Y may come in contact with the photosensitive drum 10 to injure the photosensitive layer. For this reason, instead of the toner cartridge 40 which supplements the toner to the developer unit 32 at the developing position 38, the other toner cartridge 40 is replaced thereby to reduce the risk of injuring the photosensitive drum 10.

On the other hand, the yellow toner cartridge 40Y can be replaced in the state where the developer unit 32K accommodating the black toner is opposed to the photosensitive drum 10. In this state, the yellow toner cartridge 40Y stops at the position where the replacing mouth 5 is located. Thus, it can be pulled out from the replacing mouth 5 in the axial direction of the rotary holder 31 and replaced. Further, the cyan tone cartridge 40C can be replaced when the developer unit 32M accommodating the magenta toner stops at the developing position 38.

Figure 8:
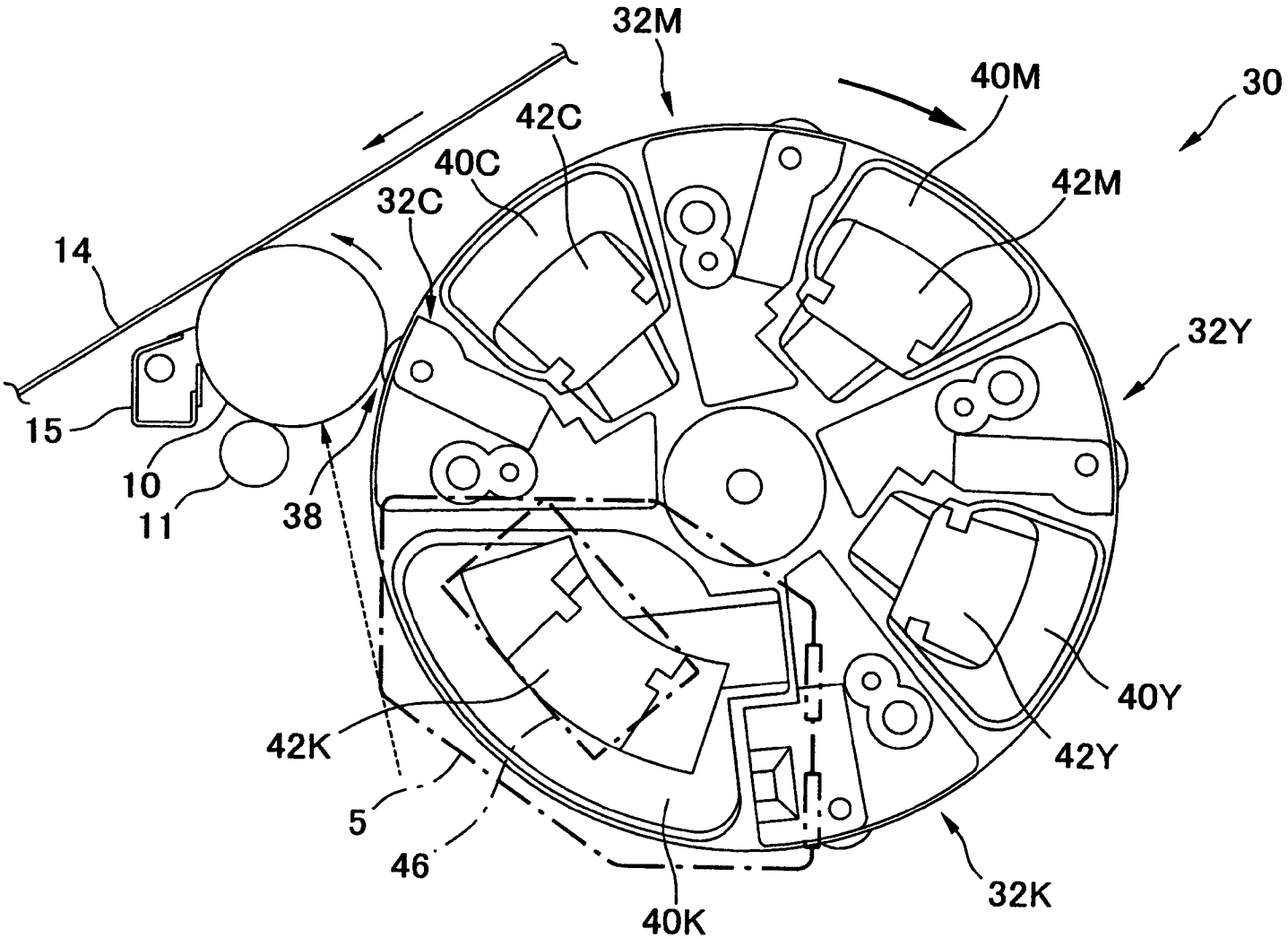
FIG. 8 is a schematic construction view showing a developing unit attached to the image forming apparatus shown in FIG. 1 and the position of a replacing mouth of a toner cartridge.

The toner cartridge 40K accommodating the black toner has a sectional size larger than those of the other toner cartridges 40C, 40M, 40Y and so occupies a larger area in the circumferential direction on the rotary holder 31. However, the black toner cartridge 40K can be also replaced when the adjacent developer unit, i.e. the developer unit 32C accommodating the cyan toner is located at the developing position 38 as shown in FIG. 8. In view of the fact that the black toner cartridge 40K has a larger size, the replacing mouth 5 is set for a size permitting the black toner cartridge 40K to be attached or detached. However, since the position where the black toner cartridge 40K stops overlaps with the position where the other toner cartridge 40C, 40M, 40Y stops for replacement, if the replacing mouth 5 is set for the size slightly larger than the sectional shape of the black toner cartridge 40K, all the toner cartridges can be replaced. This prevents reduction in strength of the supporting structure 4 due to enlargement of the replacing mouth 5.

FIG. 7 is a schematic plan sectional view of the toner cartridge 40 having stopped at the position corresponding to the replacing mouth 5 and the open/close door 6 attached to the replacing mouth 5.

As shown in FIG. 7, the open/close door 6 is supported by the supporting structure 4 through a supporting axis 4*a*. The open/close door 6 rotates outwardly around the supporting axis thereby to open the replacing mouth 5 from its closed state.

An information reading device 46 for reading the information of the IC chip provided in the toner cartridge 40 is attached the rear face of the open/close door 6. In the state where the replacing mouth 5 is closed by the open/close door 6, the information reading device 46 is opposite to the IC chip holder 42 of the toner cartridge 40, and in non-contact with the IC chip holder 42, permits the information held in the IC chip to be read or written.

The information reading device 46 is desirably opposite to the nearly entire area of the IC chip holder 42. As shown in FIGS. 2 and 8, design is made so that in both cases when the black toner cartridge 40K and other toner cartridges 40C, 40M, 40Y having different sizes stop at the position corresponding to the replacing mouth 5, the information reading device 46 is opposite to the IC chip holder 42C, 42M, 42Y, 42K to permit the information to be read or written.

It should be noted that the IC chip (not shown) and information reading device 46 may be well known products.

Next, an explanation will be given of the relationship between the position of the replacing mouth 5 for the toner cartridge 40 and operation noise, relationship between the position of reading the information from the IC chip and the operation noise and relationship between the position of the replacing mouth and the size thereof.

When the toner cartridge 40 is to be replaced, the rotary holder 31 is rotated until the toner cartridge 40 reaches the position opposite to the replacing mouth 5, i.e. a replacing position. If there is the developer unit 32 passing the developing position 38 on the way of rotation until the toner cartridge 40 reaches the replacing position, the tracking roll 37 attached to the supporting shaft 36 of the developing roll 35 collides with the opposite member 10*b* attached to the supporting shaft 10*a* of the photosensitive drum 10 at the passing speed, thereby generating colliding noise.

In this exemplary embodiment, the toner cartridge 40 is replaceable if any developer unit 32 is located at the developing position 38. So, when the rotary holder 31 stops at the replacing position of the toner cartridge 40, the developer unit 32 stops at the position opposite to the photosensitive drum 10. At this time, the tracking roll 37 stops at the moment when it comes in contact with the opposite member 10*b*, thereby preventing generation of the colliding noise. Further, if the developer unit 32 stops at the position opposite to the photosensitive drum 10 to replace the toner cartridge 40, as compared with the apparatus in which the toner cartridge is replaced in the state where the developer unit is not located at the developing position, the number of times of the developer unit 32 passing the developing position can be decreased. Thus, the number of times of generating the shocking noise due to the collision between the tracking roll 37 and the opposite member 10*b* will be decreased.

On the other hand, where the information reading device 46 reads the information contained in the toner cartridge 40, in the apparatus in which the developer unit 32 is not located at the developing position opposite to the photosensitive drum 10, the colliding noise when the rotary holder 31 is rotated to the information reading position, as in the above case at the replacing position of the toner cartridge 40, increases as compared with the apparatus in which the information is read when the developer unit 32 is located at the developing position 38.

Further, in the apparatus in which the position of reading the information contained in the toner cartridge 40 is different from the position of replacing the toner cartridge 40, in order to read the information contained in a replaced new toner cartridge 40, the rotary holder 31 must be rotation-driven to move the new toner cartridge 40 to the position opposite to the information reading device 46. If there is the developer unit 32 passing the developing position on the way of rotation, the tracking roll 37 will collides with the opposite member 10*b* to increase the colliding noise.

In this exemplary embodiment, as described above, the information stored in the IC chip of the replaced toner cartridge 40 is read by the information reading device 46 supported by the open/close door 6 attached to the replacing mouth 5. Namely, at the information reading position, one of the developer units 32 is located at the developing position and in addition the position of reading the information is the same as the position of replacing the toner cartridge. Thus, the colliding noise when the rotary holder 31 is driven in order to read the information and the shocking noise when the toner cartridge 40 is replaced will be reduced.

Further, if such a setting is made that in starting the image forming apparatus 1, the items of information peculiar to all the toner cartridges 40C, 40M, 40Y, 40K are read sequentially, the operation of reading the information is repeated four times for the respective toner cartridges 40 in such a manner that the rotary holder 31 rotates until the one toner cartridge 40 reaches the reading position and stops for reading the information. In this case, if the developer unit 32 is not located at the developing position 38 at the stopping position of the rotary holder 31, while the rotary holder 31 is driven, the developer unit 32 passes the developing position at least four times so that the tracking roll 37 provided in the developer unit 32 collides with the opposite member 10*b* four times. Thus, the colliding noise between the tracking roll 37 and the opposite member 10*b* will be generated at least four times.

On the other hand, in this exemplary embodiment, the position of reading the information contained in the toner cartridge 40 is the position of replacing the toner cartridge 40 and when the toner cartridge 40 is located at the replacing position, anyone developer unit 32 is located at the developing position 38. For this reason, even when the rotary holder 31 is rotated in order to read the information in all the toner cartridges 40, it once stops at the reading position to read the information. So, at the moment when the tracking roll 37 comes in contact with the opposite member 10*b*, movement of the tracking roll 37 is stopped, thereby generating hardly any colliding noise. Thus, the shocking noise in starting the image forming apparatus can be greatly reduced.

If it is intended to set the replacing position so that the toner cartridge 40 can be replaced when any developer unit 32 is located at the developing position 38, because the sizes of the toner cartridges 40 mounted in the rotary holder 31 are different, as the case may be, the stopping position or the replacing position may be changed for the respective toner cartridges 40. In order that the replacing mouth 5 is provided to permit all the toner cartridges 40 with the changed replacing positions to be replaced, a large opening is required so that the strength for the supporting structure 4 may be deteriorated.

On the other hand, in this exemplary embodiment, under the assumption that any developer unit 32 is located at the developing position 38 when the toner cartridge 40 is stopped at the replacing position, in order to make the replacing mouth 5 as small as possible, the replacing mouth 5 is provided so that the toner cartridge 40 arranged adjacently to the developer unit 32 at the developing position 38 is replaced. In other words, even when any of the developer units 32 accommodating the yellow, magenta, cyan, black toners is located at the developing position 38, the toner cartridge 40 arranged at the position nearest to the developing position 38 suffers form less position change. So, by providing the replacing mouth corresponding to the size of the black toner cartridge 40, all the toner cartridges can be replaced. As a result, the replacing mouth 5 having a small size can be formed.

However, when the toner cartridge 40 for supplementing the toner to the developer unit 32 located at the developing position 38 is pulled out from or inserted into the developing unit 30, owing to the shock at this time, the photosensitive drum 10 may be injured. So, the replacing mouth 5 is preferably provided at the position corresponding to the toner cartridge 40 which is adjacent to the developer unit 32 at the developing position 38 but does not supplement the toner to the pertinent developer unit 32.

Thus, as shown in FIG. 2, where the developer unit 32Y accommodating the yellow toner is located at the developing position 38, although the yellow toner cartridge 40Y and the magenta toner cartridge 40M are adjacent to the yellow developer unit 32Y, the replacing mouth 5 is provided so as to correspond to the position where the magenta toner cartridge 40M which supplements the toner to the other developer unit, i.e. magenta developer unit 32M stops.

Next, an explanation will be given of the second exemplary embodiment of this invention.

This exemplary embodiment is different from the first exemplary embodiment in the position of the replacing mouth for replacing the toner cartridge, but the same as the first exemplary embodiment in the other configuration. So, with the like symbols referring to like elements, the same configuration will not be explained.

In the image forming apparatus, a replacing mouth 50 is provided at the position where when any developer unit 32 is located at the developing position 38, the toner cartridge 40 for supplementing the toner to another developer unit 32 adjacent to the toner cartridge 40 for supplementing the toner to the pertinent developer unit 32 can be replaced.

Figure 9:
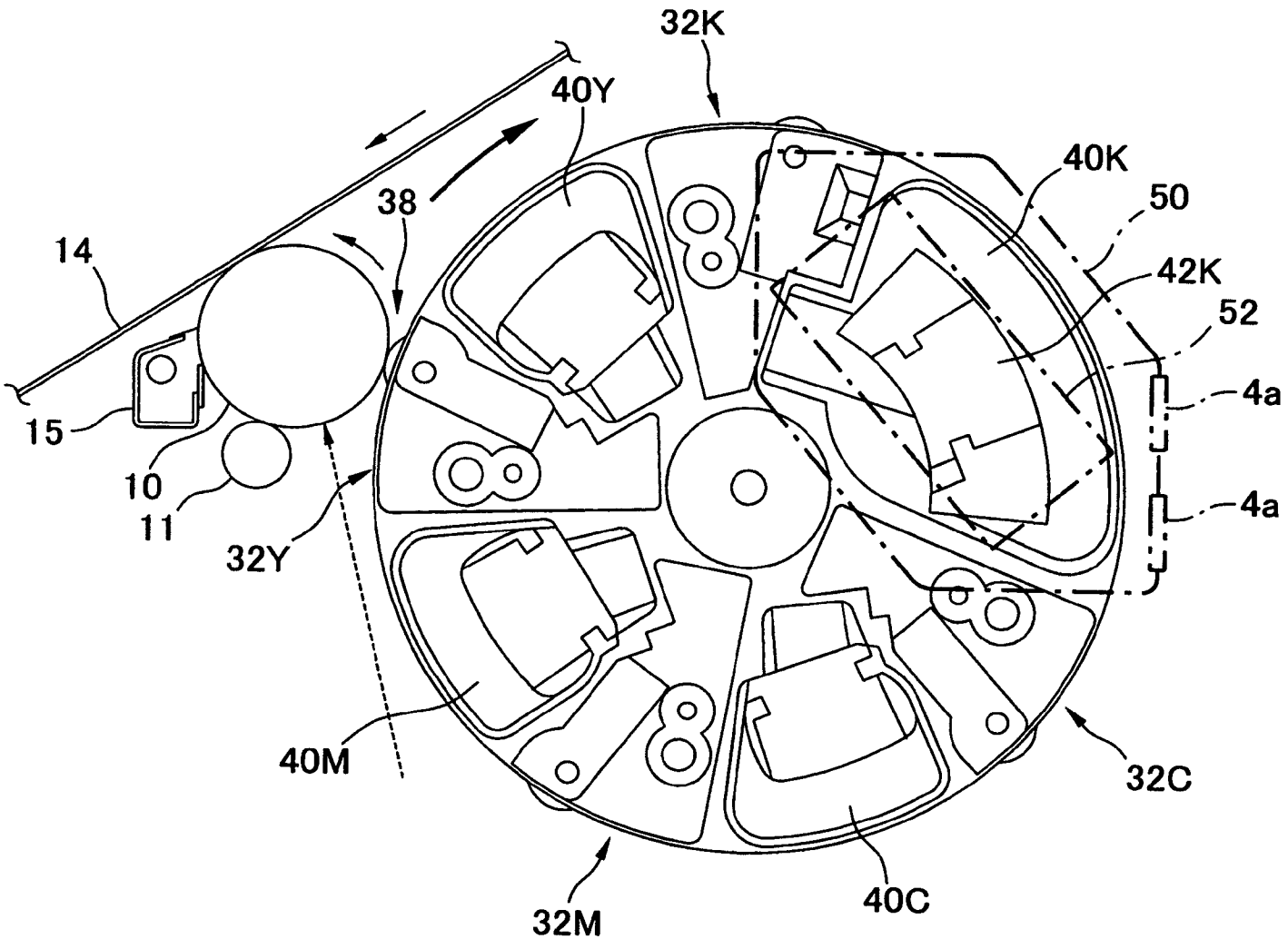
FIG. 9 is a schematic construction view showing a developing unit included in the image forming apparatus according to another exemplary embodiment of this invention and the position of a replacing mouth of a toner cartridge.

For example, as shown in FIG. 9, when the developer unit 32Y accommodating the yellow toner is located at the developing position 38, another developer unit 32 adjacent to the toner cartridge 40Y supplementing the yellow toner to the developer unit 32Y is the developer unit 32K for the black toner. At the position where the black toner cartridge 40K supplementing the toner to this developer unit 32K can be replaced, the replacing mouth 50 is provided. Namely, the black toner cartridge 40K located at the position apart from the developer unit 32Y for yellow at the developing position 38 by the yellow toner cartridge 40Y and developer unit 32K accommodating the black toner. The black toner cartridge 40K occupies an area larger than the other toner cartridges 40C, 40M, 40Y in the circumferential direction of the rotary holder 31. Correspondingly, the replacing mouth 50 is set for the size permitting this black toner cartridge 40*k* to be replaced.

Figure 10:
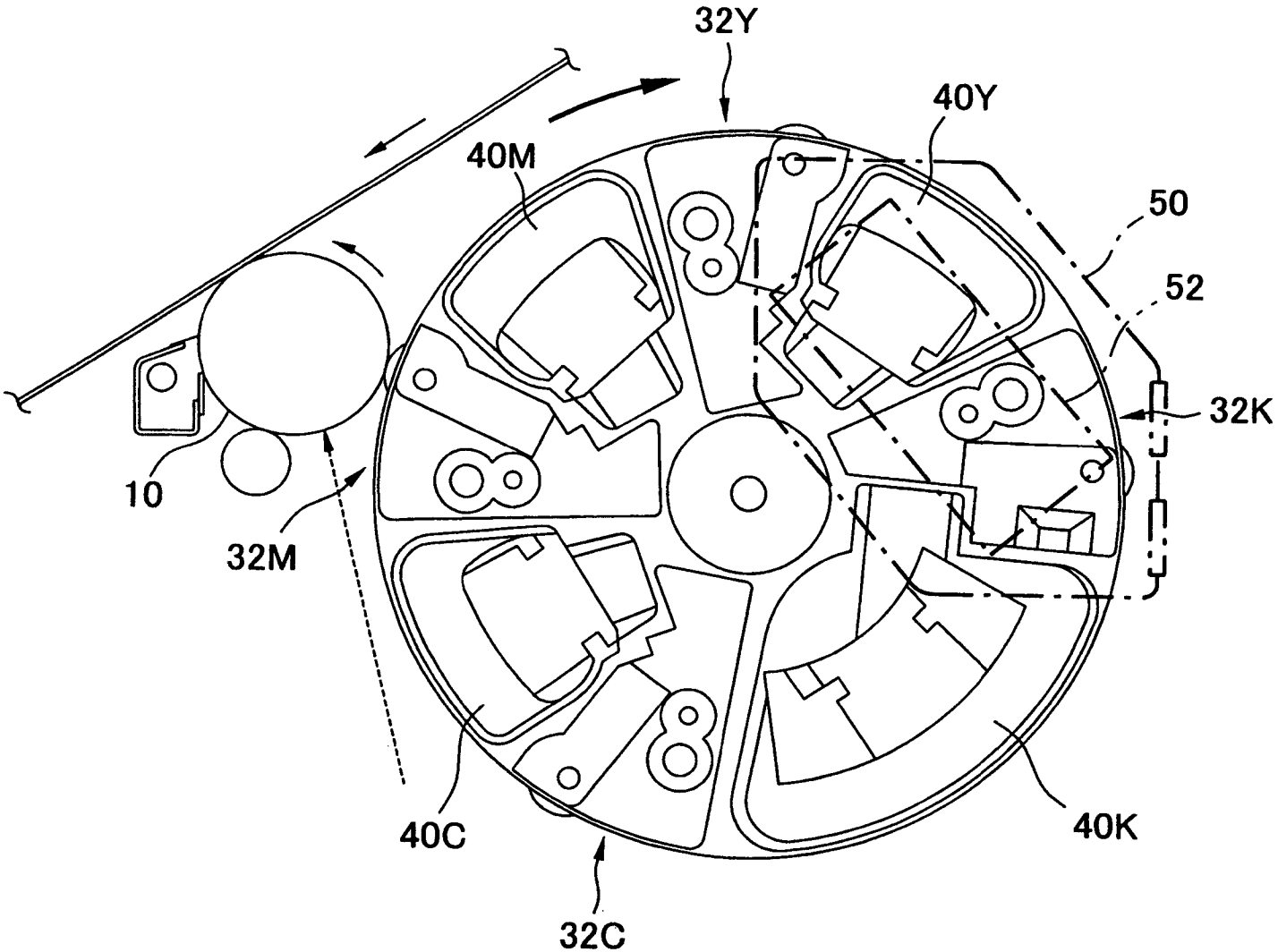
FIG. 10 is a schematic construction view showing a developing unit included in the image forming apparatus shown in FIG. 9 and the position of a replacing mouth of a toner cartridge.
Figure 11:
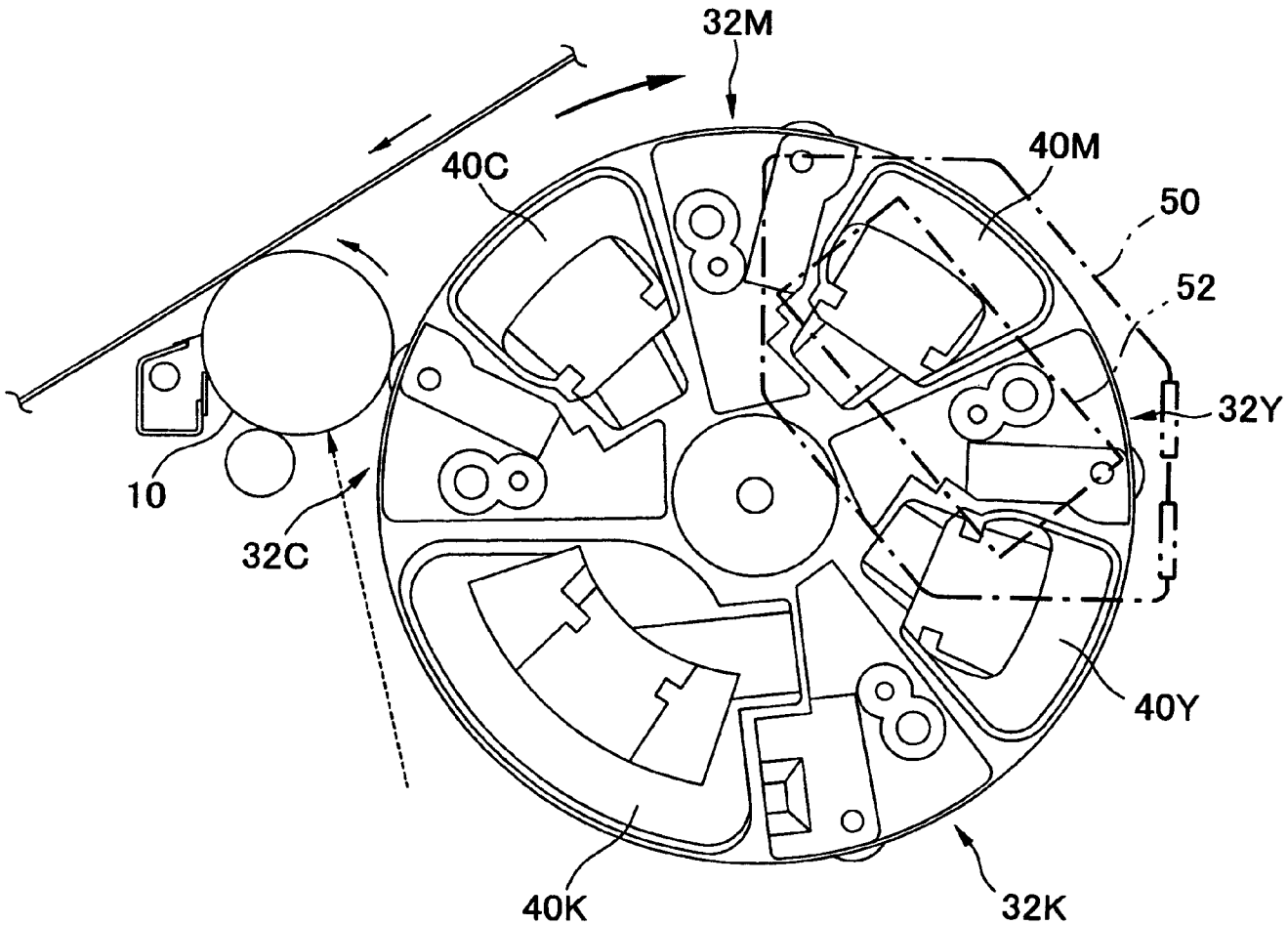
FIG. 11 is a schematic construction view showing a developing unit included in the image forming apparatus shown in FIG. 9 and the position of a replacing mouth of a toner cartridge.
Figure 12:
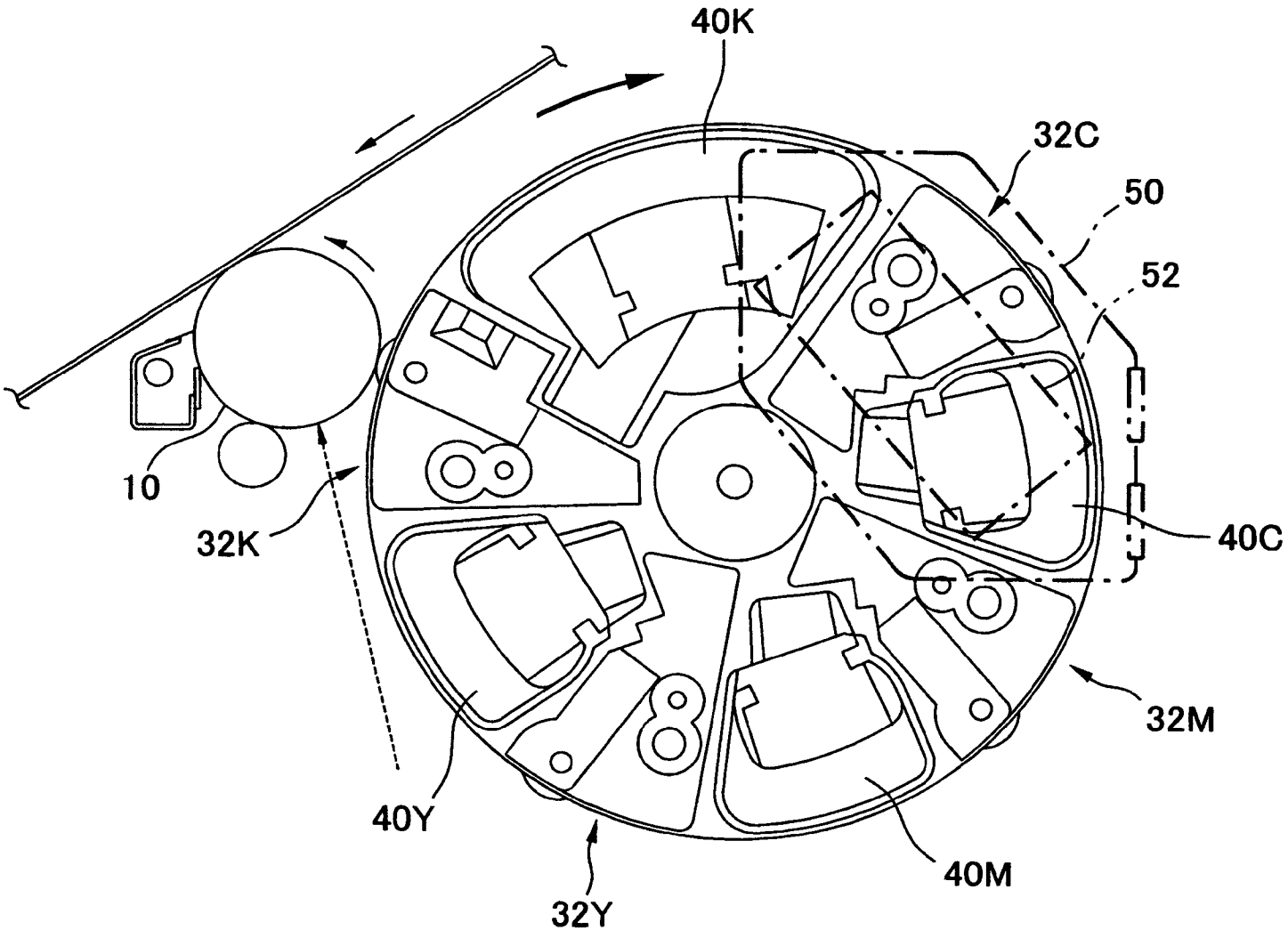
FIG. 12 is a schematic construction view showing a developing unit included in the image forming apparatus shown in FIG. 9 and the position of a replacing mouth of a toner cartridge.

When the developer unit 32M accommodating the magenta toner is located at the developing position 38 as shown in FIG. 10, the replacing mouth 50 permits the yellow toner cartridge 40Y to be replaced. When the developer unit 32C accommodating the cyan toner is located at the developing position 38 as shown in FIG. 11, the replacing mouth 50 permits the magenta toner cartridge 40M to be replaced. Further, when the developer unit 32K accommodating the black toner is located at the developing position 38 as shown in FIG. 12, the replacing mouth 50 permits the cyan toner cartridge 40C apart from the developer unit 32K for the black toner by the black toner cartridge 40K and developer unit 32C accommodating the cyan toner to be replaced. When the developer unit 32K accommodating the black toner is located at the developing position 38, since the black toner cartridge 40K located between itself and the cyan toner cartridge 40C is larger in size, the position of the cyan toner cartridge 40 is displaced. However, the replacing mouth 50 is set for the size permitting this cyan toner cartridge 40C to be replaced.

The replacing mouth 50 is provided with an open/close door (not shown). On the rear surface of the open/close door, an information reading device 52 having a size corresponding to the IC chip holder 42C, 42M, 42Y, 42K of each toner cartridge 40C, 40M, 40Y, 40K is provided. As regards the toner cartridge 40, the black toner cartridge 40K is larger in size; and in addition, the replacing position of the cyan toner cartridge 40C is replaced from those of the yellow toner cartridge 40Y and magenta toner cartridge 40M. However, when any of the toner cartridge 40C, 40M, 40Y, 40K stops at the replacing position, the above information reading device 52 can become opposite to the IC chip holder 42C, 42M, 42Y, 42K.

In such an image forming apparatus also, the replacing mouth 50 for replacing the toner cartridge 40 is provided so as to replace the toner cartridge 40 when one of the developer units 32 stops at the developing position corresponding to the photosensitive drum 10. In addition, the position of reading the information from the storage medium included in the toner cartridge 40 is set so that one of the developer units 32 is located at the developing position 38 opposite to the photosensitive drum 10. Thus, the shocking noise when the tracking roll 37 collides with the opposite member 10*b* on the side of the photosensitive body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder on which an electrostatic latent image due to a difference in a charging potential is formed;

a developing unit that transfers toners to the electrostatic latent image formed on the image holder to form a visual image;

a transfer device that transfers the visual image onto a recording sheet; and a supporting structure that supports the image holder and the developing unit, wherein the developing unit includes:

a rotary body of which supporting shaft is supported at both ends by the supporting structure and which is rotatable around an axial line of the supporting shaft;

a plurality of developer units that are arranged in a circumferential direction and supported by the rotary body and respectively have developer holders for holding developers to develop the electrostatic latent image of the image holder; and toner cartridges provided to supplement toners to the developer units, respectively so as to be attached to or detached from the rotary body, the plurality of developer units and the toner cartridges are alternately arranged in the circumferential direction of the rotary body, at least one of the plurality of toner cartridges is larger than the other toner cartridges in the circumferential direction of the rotary body, the supporting structure is provided with a replacing mouth that permits each of the toner cartridges to be inserted in or pulled out from the rotary body in an axial direction thereof, and the replacing mouth is located at a position that, when a first developer holder stops at a position used when executing development in opposition to the image holder, a second toner cartridge that supplements the toner to a second developer unit is capable of being replaced, the second developer unit being different from and arranged adjacently to a first developer unit provided with the first developer holder.

2. The image forming apparatus according to claim 1, wherein each of the toner cartridges has a storage medium containing information peculiar to the toner cartridge, the supporting structure or a member supported by the supporting structure includes an information reading device being opposite to the storage medium and reading the information stored in the storage medium in a non-contact manner, and the information reading device reads the information from the storage medium, when any of the developer units is located at a developing position opposite to the image holder.

3. The image forming apparatus according to claim 2, wherein the replacing mouth provided in the supporting structure is provided with an opening-and-closing door, the information reading device is attached to the opening-and-closing door, and the information reading device reads the information from the storage medium of the toner cartridge at a position where the toner cartridge is capable to be replaced.

4. An image forming apparatus comprising:

an image holder on which an electrostatic latent image due to a difference in a charging potential is formed;

a developing unit that transfers toners to the electrostatic latent image formed on the image holder to form a visual image;

a transfer device that transfers the visual image onto a recording sheet; and a supporting structure that supports the image holder and the developing unit, wherein the developing unit includes:

a rotary body of which supporting shaft is supported at both ends by the supporting structure and which is rotatable around an axial line of the supporting shaft;

a plurality of developer units that are arranged in a circumferential direction and supported by the rotary body and respectively have developer holders for holding the developers to develop the electrostatic latent image of the image holder; and toner cartridges provided to supplement toners to the developer units, respectively so as to be attached to or detached from the rotary body, the plurality of developer units and the toner cartridges are alternately arranged in the circumferential direction of the rotary body, at least one of the plurality of toner cartridges is larger than the other toner cartridges in the circumferential direction of the rotary body, the supporting structure is provided with a replacing mouth that permits each of the toner cartridges to be inserted in or pulled out from the rotary body in an axial direction thereof, and the replacing mouth is located at a position that, when one of the developer holders stops at a position used when executing development in opposition to the image holder, a toner cartridge that supplements the toner to a developer unit is capable of being replaced, the developer unit being different from and arranged adjacently to one developer unit provided with the one developer holder.

* * * * *